US005263773A

United States Patent [19]

Gable et al.

[11] Patent Number: 5,263,773

[45] Date of Patent: Nov. 23, 1993

[54] CABINET STRUCTURE AND METHOD OF PRODUCING SAME

[75] Inventors: Don H. Gable, Greenville; Samuel L. Nostrant, Remus, both of Mich.

[73] Assignee: White Consolidated Industries, Inc., Cleveland, Ohio

[21] Appl. No.: 792,341

[22] Filed: Nov. 14, 1991

[51] Int. Cl.[5] ..... A47B 81/00

[52] U.S. Cl. ..... 312/406; 220/442; 220/444; 220/455; 220/669; 428/187

[58] Field of Search ..... 312/400, 401, 406, 406.1; 72/379.2; 220/442, 443, 444, 455, 467, 669; 428/187, 163

[56] References Cited

U.S. PATENT DOCUMENTS

| | | | |
|---|---|---|---|
| 2,729,863 | 1/1956 | Kurtz | 220/467 X |
| 3,813,137 | 5/1974 | Fellwock et al. | 220/467 X |
| 5,114,194 | 5/1992 | Tuifl et al. | 292/106 |

*Primary Examiner*—Kenneth J. Dorner

*Assistant Examiner*—Brian K. Green

*Attorney, Agent, or Firm*—Pearne, Gordon, McCoy & Granger

[57] ABSTRACT

An appliance cabinet such as a refrigerator cabinet is formed of sheet steel which is textured by coining along one surface and provides a substantially smooth surface on the opposite side. The coining operation results in shallow, projecting irregularities on the substantially smooth side of the sheet steel. Non-textured cabinets are formed by bending and joining the sheet steel to form a cabinet shell having the textured side of the sheet steel on the inside and a substantially smooth surface of the sheet steel on the outside. When a finished paint coating is applied to the substantially smooth side, a leather-like surface appearance results. When the sheet steel is bent and formed into a shell for a cabinet with the textured side on the outside, a textured cabinet results. By forming both types of cabinets from the same sheet steel, manufacturing savings result because only one type of sheet steel must be procured and inventoried.

5 Claims, 1 Drawing Sheet

CABINET STRUCTURE AND METHOD OF PRODUCING SAME

BACKGROUND OF THE INVENTION

This invention relates generally to a novel and improved cabinet structure, particularly suited for appliance cabinets and to a novel and improved method of producing such cabinets.

Prior Art

Cabinets for appliances such as refrigerators and the like are typically formed of sheet steel which is bent and joined to provide the cabinet. In some cases, the metal is pre-painted and then fabricated to produce the cabinet. In other instances, the painting occurs after fabrication as a post-painting operation.

In some instances, the cabinets are formed of sheet metal having a smooth surface on both sides. In such instances, paint is sometimes applied in a manner causing an orange peel type surface to reduce the full gloss appearance so that slight scratches or the like are not as apparent. In other instances, the sheet steel is embossed or coined during manufacture to provide a textured surface along one side and a substantially smooth opposite surface. In such instances, the fabrication is performed so that the textured surface is on the outside and after painting, the cabinet is provided with a textured exposed surface.

Since manufacturers of cabinets often produce both textured and non-textured cabinets, it has been necessary in the past to procure and inventory both smooth and textured materials.

SUMMARY OF INVENTION

There are several aspects to the present invention. In accordance with one important aspect of this invention, cabinets such as cabinets for refrigerators, appliances, and the like are formed from sheet steel which is textured on the inside and provides an external substantially smooth surface. Such material, although it provides a substantially smooth outer surface, provides very shallow surface irregularities resulting from the coining operation used to texture the inner surface. These surface irregularities are carried through the finish paint or coating and result in an aesthetically desireable patina or leather-like and grained appearance. However, because the surface irregularities are very shallow and do not provide sharp edges or indentations, the thickness of the finish coating is very uniform and is uniformly wear-resistant. Further, this leather-like surface, because it is free of relatively deep and relatively narrow indentations, is easily cleaned.

Further, when the cabinet is formed of pre-painted sheet steel, the bending operations can be reliably produced without rupturing the coating which has a substantially uniform thickness. This is an important consideration since even non-visible pin holes in the coating along bends can result in damaging corrosion.

In accordance with another important aspect of this invention, production costs are reduced. A method of manufacture with this invention allows the manufacturer of cabinets having non-textured exposed surfaces and textured exposed surfaces from the same stock of sheet steel. When producing cabinets having a textured exposed surface, the cabinet is produced with the textured surface on the outside. When producing cabinets having the non-textured leather-like exposed surface, the sheet stock is inverted and the cabinet is produced with the textured surface on the inside. Therefore, only a single type of sheet steel need be procured and inventoried. This results in substantial production cost savings.

Further, since the textured sheet steel tends to be more rigid than flat sheet steel of the same thickness, it is possible, in some instances, to use a thinner sheet steel when producing cabinets having non-textured external surfaces.

These and other aspects of this invention are illustrated in the accompanying drawings and are more fully described in the following specification.

DETAILED DESCRIPTION OF THE DRAWINGS

Figure 1:
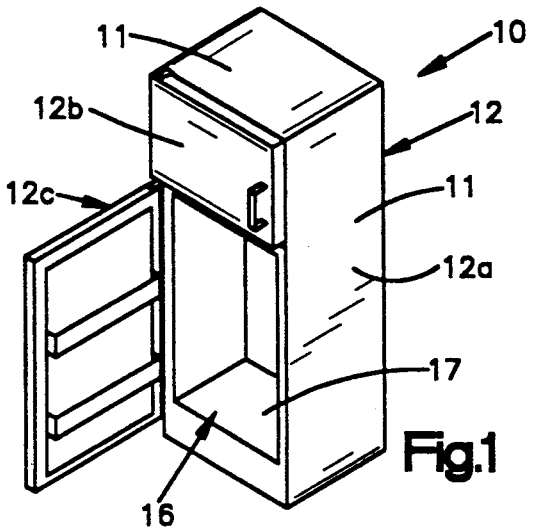
FIG. 1 illustrates a typical refrigerator having a cabinet formed of sheet steel which is textured along the inner surface and provides a leather-like exterior surface.
Figure 2:
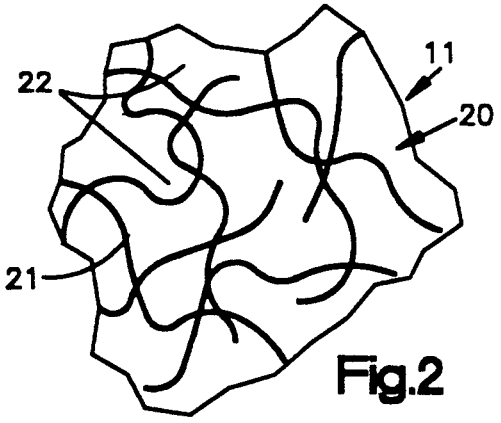
FIG. 2 is an enlarged fragmentary view illustrating the textured side of the sheet steel.
Figure 3:
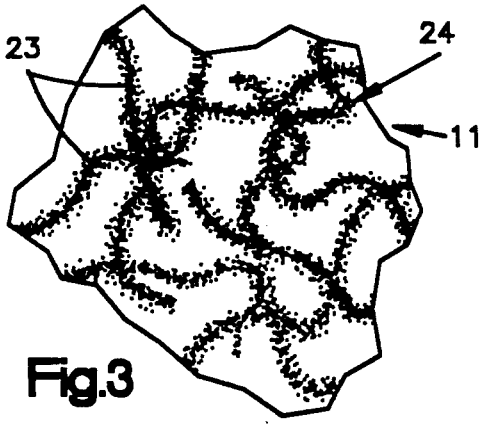
FIG. 3 is an enlarged fragmentary view of the leather-like exterior surface of the sheet steel.
Figure 4:
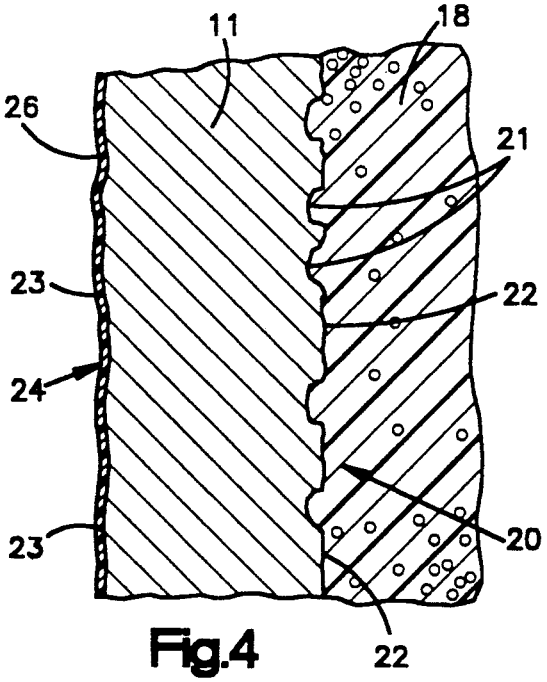
FIG. 4 is a greatly enlarged fragmentary section illustrating a portion of the refrigerator cabinet having the textured side of the sheet steel along the interior surface against the foam insulation and a leather-like exterior surface.
Figure 5:
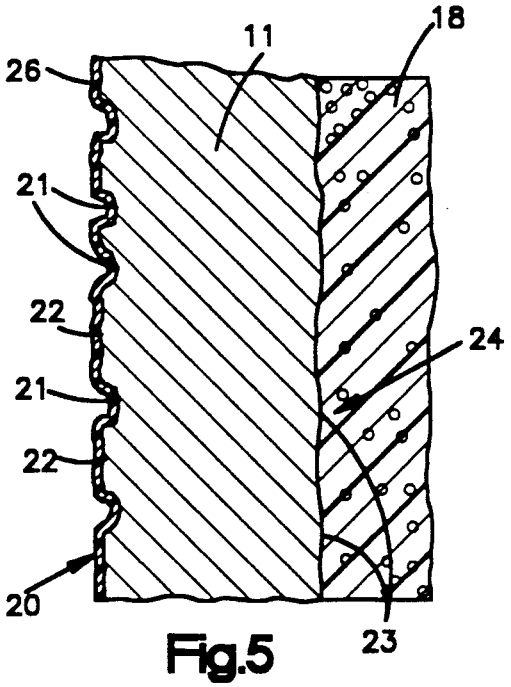
FIG. 5 is a greatly enlarged fragmentary section similar to FIG. 4 but illustrating a refrigerator cabinet with a textured exterior surface.

FIG. 1 illustrates a typical refrigerator 10 provided with a cabinet 12 in accordance with the present invention. This particular refrigerator provides a main cabinet portion 12*a* and upper and lower cabinet doors 12*b* and 12*c*. The door 12*b* provides access to a freezer compartment and the door 12*c* provides access to the fresh food compartment 16. Typically, the cabinet or outer shell of the refrigerator is formed of sheet steel 11 with a plastic liner 17 mounted therein. Rigid foam insulation 18, illustrated in FIGS. 4 and 5, is located between the liner and the adjacent portion of the shell. A corrosion-resistant paint-type coating 26 is applied along the exterior surfaces of the cabinet. Such coating can be applied as a pre-coating on the sheet steel 11 before it is bent and joined to form the cabinet or may be applied as a post-painting operation.

It should be understood that although this invention is illustrated and specifically described in connection with a cabinet for refrigerators, it is equally applicable to cabinets in general and of course, cabinets for other types of appliances.

As mentioned above, it is known to produce cabinets having a smooth exterior surface by forming the cabinet of sheet steel which is smooth on both sides. It is also known to provide cabinets which have a textured exterior surface by forming the cabinet with sheet steel which has been embossed to provide a textured surface on one side. In the case of cabinets formed of sheet steel which is smooth on both sides, the surface of the finished paint coating tends to be very smooth and glossy unless an orange peel type finish is applied. Even in the instance of coatings having an orange peel type surface, the surface tends to be quite smooth and has only a slight stipple-like appearance.

With the present invention, a softer-appearing, leather-like, grained finish is provided on cabinets formed of textured sheet steel positioned so that the textured side is on the interior of the cabinet and the finish coating is applied to the opposite or substantially smooth side of the textured sheet steel.

As best illustrated in FIGS. 2 through 5, the textured sheet steel utilized in accordance with the present invention, is formed by coining smooth sheet steel between an embossing roll having a multiplicity of narrow projections and a smooth backup roll. As the smooth sheet steel is passed between the embossing roll and the smooth backup roll, these projections penetrate into one surface of the sheet steel and provide a coining operation in which a multiplicity of small shallow grooves 21 are formed in one surface of the sheet to provide a textured side 20. These shallow grooves 21 are typically arranged in a random manner so that a textured finish is provided on one side of the sheet. Since the grooves are formed by an embossing roll which penetrates into the surface thereof, the adjacent portions of the surface provide a multiplicity of relatively flat, plateau-like portions 22.

The forming of the grooves 21 in this coining-type operation produces plastic flow and displacement of the material where each groove is formed. Since the material displaced to produce the grooves 21 must flow somewhere, the opposite side of the sheet is provided with projecting surface irregularities 23 corresponding to the grooves. However, since the embossing is performed against a smooth roll, these surface irregularities 23 are very low and smoothly curved and the embossed and textured sheet steel provides a substantially smooth surface 24 having very slight surface irregularities 23 projecting therefrom.

For example, if the grooves embossed into the textured side 20 of a sheet, having a thickness of about 0.035 inches, are in the order of 0.003 inches, the displaced steel projects above the adjacent surfaces along the substantially smooth side 24 by an amount no greater than about one-third of the depth of the grooves or less than about 0.001 inches.

Further, these raised irregularities 23 on the substantially smooth side, are substantially wider than the adjacent groove because the material during such plastic deformation tends to flow outwardly during the coining operation. The resulting projecting irregularities 23 on the substantially flat side 24 of the sheet 11 are very smoothly curved because of this lateral flow from the location of highest force concentration. In f act, the appearance of the substantially smooth side is leather-like in that it provides a grain-like structure which is random in pattern in a manner corresponding to the embossed grooves on the textured side of the sheet.

This leather-like appearance carries through the coating 26 and provides a finish surface having a grained, leather-like appearance. Further, because the coating is applied to a substantially smooth surface 24, the coating thickness is more uniformly maintained than when applied to the textured side which has fairly narrow and sharply defined shallow grooves.

Such finish is more pleasing and its appearance is more durable compared to a coating applied to the textured side of the sheet. Further, because it is substantially devoid of sharp changes in contour, it is easier to clean and maintain. Still further, in the event that the coating is applied before the sheet steel is bent and joined to produce the cabinet 12, the likelihood of pin holes along the bends in the finished cabinet are virtually eliminated. Consequently, the corrosion-resistance is maintained even at relatively sharp bends and corrosion does not present a problem in the finished product.

FIGS. 4 and 5 are greatly enlarged fragmentary cross sections of the sheet steel formed into a cabinet in accordance with the present invention and illustrate how the shallow grooves 21, having a depth in the order of 0.003 inches, cause wider, much shallower and smoother projecting surface irregularities 23 having a height no more than one-third the depth of the corresponding groove or in such instance a height no more than about 0.001 inches. Further, because the profile of the projecting surface irregularities is rounded and has a width substantially wider than the width of the grooves, a substantially smooth surface 24 exists. In FIG. 4 a cross section illustrates a cabinet with the substantially smooth side 24 on the exterior of the cabinet and the textured side 20 is on the interior of the cabinet against the foam insulation 18. When the cabinet is produced in such a manner, a coating 26 applied to the substantially smooth side provides a very uniform thickness which is not only wear-resistant, but also aesthetically pleasing in that it provides a grained, leather-like surface appearance. Such surface is very easily cleaned because it is devoid of any narrow indentation.

FIG. 5 on the other hand, illustrates a similar, greatly enlarged scale of the cross section of a cabinet formed of the same sheet steel, but wherein the textured side 20 is on the exterior and the substantially smooth side 24 is against the insulation 18.

It should be understood that the coating 26 can be applied as a pre-coating operation before the sheet steel is bent and joined to form the cabinet or can be applied as a post-coating or painting operation.

In accordance with this invention, a method is provided in which the same stock of sheet steel, which is textured on one side and substantially smooth on the other, is used to manufacture cabinets which are textured or non-textured. When producing cabinets having a textured exterior surface, the textured side 20 of the sheet is located on the exterior of the cabinet, as illustrated in FIG. 5. When producing a non-textured cabinet, the substantially smooth side 24 of the sheet is located on the exterior side as illustrated in FIG. 4.

Because textured sheet steel tends to be more rigid than non-textured sheet steel of the same thickness, it is possible with this invention to produce both textured and non-textured cabinets utilizing a thinner gauge stock. Manufacturing savings are achieved since it is not necessary to procure and inventory two types of material to form the cabinets and because in some cases, the thickness of the stock can be reduced when manufacturing a given cabinet.

Although the preferred embodiment of this invention has been shown and described, it should be understood that various modifications and rearrangements of the parts may be resorted to without departing from the scope of the invention as disclosed and claimed herein.

What is claimed is:

1. An appliance cabinet comprising sheet metal bent and joined to form the appliance cabinet, said sheet metal having an inner surface having grooves having a depth arranged in a pattern along said inner surface to provide a texture on the inner surface, said sheet metal having an outer surface having smooth, projecting irregularities resulting from the forming of said grooves and having a height substantially less than said depth of grooves, and a protective finish coating on said outer surface, said projecting irregularities causing said coating to provide a leather-like surface appearance.

2. An appliance cabinet as set forth in claim 1, wherein said projecting irregularities have a height no greater than about $\frac{1}{3}$ of the depth of said grooves.

3. An appliance cabinet as set forth in claim 2, wherein said grooves have a depth of about 0.003 inches and said projecting irregularities have a height no greater than about 0.001 inches.

4. A refrigerator comprising a cabinet having a shell formed of bent and joined sheet metal, a liner, and insulation between said shell and liner, said sheet metal having an inner surface adjacent to said insulation, said inner surface having grooves coined into said inner surface, said grooves having a depth so as to form a texture on the inner surface, said sheet metal having a substantially smooth outer surface having projecting irregularities resulting from said coining of said grooves, said irregularities having a height substantially less than the depth of the grooves, and a finish coating on said outer surface providing a leather-like surface appearance.

5. A refrigerator as set forth in claim 4, wherein said finish coating is substantially uniform in thickness and provides surface irregularities created by said projecting irregularities on said substantially smooth outer surface.

* * * * *

UNITED STATES PATENT AND TRADEMARK OFFICE

CERTIFICATE OF CORRECTION

PATENT NO. : 5,263,773

DATED : November 23, 1993

INVENTOR(S) : Don H. Gable and Samuel L. Nostrant

It is certified that error appears in the above-identified patent and that said Letters Patent is hereby corrected as shown below:

Column 3, line 52, delete "f act" and insert --fact--.

Columns 4 and 5, Claim 1, line 8, after "of" insert --the--.

Signed and Sealed this

Seventh Day of June, 1994

Bruce Lehman

*Attest:*

BRUCE LEHMAN

*Attesting Officer*

*Commissioner of Patents and Trademarks*